United States Patent [19]

Kelso, Jr.

[11] 4,303,705

[45] Dec. 1, 1981

[54] TREATMENT OF WOOD WITH WATER-BORNE PRESERVATIVES

[76] Inventor: William C. Kelso, Jr., 14 Bulldog Dr., Starkville, Miss. 39759

[21] Appl. No.: 836,986

[22] Filed: Sep. 27, 1977

[51] Int. Cl.[3] ..... B05D 1/18; B05D 3/02; B05D 3/12

[52] U.S. Cl. ..... 427/351; 427/370; 427/397; 427/440

[58] Field of Search ..... 427/325, 331, 440, 441, 427/297, 370, 397, 351; 21/7

[56] References Cited

U.S. PATENT DOCUMENTS

| | | | |
|---|---|---|---|
| 2,799,597 | 7/1957 | Walker et al. | 427/441 X |
| 2,909,450 | 10/1959 | Goldstein | 427/294 |
| 3,080,212 | 3/1963 | Oberley et al. | 21/7 |
| 3,200,003 | 8/1965 | Bescher | 427/440 |
| 3,560,251 | 2/1971 | Hager | 427/351 |
| 3,874,908 | 4/1975 | Liddell | 21/7 X |
| 3,968,276 | 7/1976 | Allen | 427/440 X |
| 4,062,991 | 12/1977 | Kyte et al. | 427/440 X |

FOREIGN PATENT DOCUMENTS

| | | | |
|---|---|---|---|
| 613300 | 1/1961 | Canada | 427/440 |

*Primary Examiner*—Michael R. Lusignan

[57] ABSTRACT

A process for the treatment of wood is disclosed in which water-borne wood treatment materials, such as CCA salts, are forced into the wood under pressure and the water-borne wood treatment materials are held within the wood under pressure until they are deposited as by precipitation or chemical affixation. The precipitation or chemical affixation step is conducted at elevated temperatures. The elevated temperatures may be established by heating the wood treatment materials while they are in contact with the wood, by draining the wood treatment materials from external contact with the wood, while maintaining a sufficient pressure to prevent kickback and heating the wood as by steaming or by submerging the wood in a heated aqueous bath. If a heated aqueous bath is used it may advantageously contain additional wood treatment materials such as wood-softening agents, antichecking agents, filmformers, coloring agents, dimensional stabilizers, flame-retardants, antistatic agents and the like.

In a preferred embodiment, the wood is placed under an initial pressure, lower than the impregnation pressure, so that the kick-back is maximized and the liquid retained within the wood is minimized.

12 Claims, No Drawings

TREATMENT OF WOOD WITH WATER-BORNE PRESERVATIVES

FIELD OF THE INVENTION

This invention relates to the pressure impregnation of wood with water-borne wood treatment materials to improve the properties of the wood. More particularly, this invention relates to a modified empty-cell process for the impregnation of wood in which water-borne wood treatment materials, such as CCA salts, are deposited within the wood, as by precipitation or chemical affixation, during a separate and distinct phase of the pressure impregnation cycle which is conducted prior to the time that kickback is permitted.

DESCRIPTION OF THE PRIOR ART

It has been common practice for many years to impregnate wood with preservatives and the like by utilizing pressure impregnation processes. The impregnants are selected to reduce decay and rot of the wood; to protect the wood from attack by fungus, micro-organisms and other pests; and to improve the properties of the wood as by giving it greater dimensional stability, preventing checking, or making it less flammable. The pressure impregnation processes are advantageous as compared with nonpressure methods in that they achieve a deeper and more uniform penetration and a higher absorption of the treatment material in the wood in a comparatively short period of time.

The various processes for the pressure impregnation of wood are usually classified as being either "full-cell" or "empty-cell" processes. In the full-cell process, the liquid forced into the wood is largely retained by the wood after impregnation, whereas in the empty-cell process, most of the treatment liquid is expelled from the wood after impregnation. The terms "full" and "empty" derive from the fact that the cells of the wood are substantially filled with impregnants in the full-cell process, but tend only to be coated with the impregnant in the empty-cell process.

The full-cell process makes use of a vacuum/pressure impregnation cycle in which the wood is first placed under vaccum and then, without admitting air, the treatment vessel is filled with the treatment liquid. After the wood is fully immersed in the liquid, the pressure is increased to perhaps ten atmospheres or so, and the liquid is forced into the wood. After the wood has been treated to refusal, or until a predetermined gross absorption of the treatment liquid has been achieved, the pressure is relieved and the treatment fluid is drained from the vessel. Usually a short vacuum cycle follows to remove excess liquid from the surface of the wood.

In distinction to the full-cell process, the empty-cell process does not make use of an initial vacuum, but rather, as most commonly practiced, the wood is placed under pressure prior to the time that it is contacted with the treatment liquid. While maintaining this initial pressure, the treatment vessel is filled with the treatment liquid and the pressure is increased to a second higher pressure so that the treatment liquid is forced into the wood against the air pressure initially established within the wood. As a result, when the pressure is relieved at the end of the impregnation cycle, the air compressed within the wood expands and expels much of the liquid that was forced into the wood. (Sometimes the empty-cell process is modified by omitting the initial pressurization of the wood before impregnation.) Usually, as is the case with the full-cell treatment, a vacuum is pulled on the treatment vessel at the end of the process to increase the recovery of the treatment fluid and shorten the period of time during which the fluid will drip from the surface of the wood.

The wood impregnated by the empty-cell process differs from the wood of the full-cell process in that the treated wood is not saturated with the treatment liquid. The empty-cell process is therefore especially advantageous when treating wood with water-borne materials since the wood, after treatment, is ready for shipment, further treatment or immediate use since there is no large quantity of water which must be removed from the wood. On the other hand, the full-cell process is used when it is the purpose of the impregnation process to keep as much of the treatment liquid in the wood as possible, such as when the impregnant is creosote or another petroleum-based preservative.

The term of art used in describing the liquid that is expelled from the interior of the wood after the pressure has been relieved in the empty-cell process is "kickback". When treating wood with water-soluble preservatives, such as CCA salts, kickback is undesirable because the kickback will include water-soluble reducing substances leached from the wood (e.g., hemicelluloses) which will react with the CCA salts and precipitate a dense sludge that will foul the equipment. (For the purposes of this specification and the appended claims, "CCA salts" is used to mean not only the standard chromium/copper/arsenic salts, but also modifications of these salts including those containing other soluble metal ions such as zinc salts.) In current practice, the kickback is collected in the tank containing the working treatment liquid and the insoluble material must periodically be removed between treatment cycles. It is desirable to make use of the kickback to utilize the residual salts and also because of the toxicity of the kickback and the hazard its discharge would pose to the environment. For these reasons, it has been standard practice to utilize the full-cell process for impregnating wood with CCA salts since, other than the small amount of vacuum drip, there is no kickback.

Another difficulty encountered when the kickback is reused is that the several salts used in treatment solutions, particularly the CCA salts, are extracted by the wood at different rates, requiring the kickback to be analyzed and the balance between the several salts restored before reuse.

It is for these reasons—that is, minimizing the amount of kickback liquid that must be treated forrecycling or disposal—that full-cell pressure impregnation processes are conventionally used to impregnate wood with water-soluble wood preservatives such as CCA salts.

Unfortunately, there are disadvantages attendant to the full-cell process when the object is to deposit the water-borne materials of the treatment liquid in the wood rather than to retain the liquid within the wood, among which the following can be listed:

The weight of the wood is greatly increased when it is filled with a treatment liquid, such as water, and, as a result, the wood must be dried in kilns or left to air-dry for a number of months to make shipment reasonably economic.

It is sometimes desirable to follow the initial impregnation of the wood with a second impregnation. For example, to achieve maximum preservation of wood for marine purposes, wood is first treated with a CCA salt and later impregnated with creosote. However, before any useful amounts of creosote can be driven into the wood, the retained water from the CCA salt treatment must be removed, either by costly kiln drying or lengthy air drying.

CCA salts tend to discolor wood during a drying operation. This discoloration occurs due to the migration of the salts to the surface of the wood during drying. The discoloration and color changes in the wood are believed to be photoactivated and any portion of the surface of the wood that is exposed to sunlight will turn a different color from those portions that are in the shade. This largely destroys the value of the wood for those uses in which the appearance of the wood is important.

Workers who handle wood saturated in the full-cell process may find it necessary to wear protective gear, such as gloves and aprons, if they have a sensitivity to the impregnating salts.

But even with these and other limitations inherent in practicing the full-cell process, the full-cell process is usually preferred over the empty-cell process simply because returning the kickback to the working solution or otherwise disposing of the kickback presents even greater problems.

SUMMARY OF THE INVENTION

Accordingly, it is an object of this invention to provide a modified empty-cell process for the impregnation of wood.

Another object of this invention is to provide an empty-cell type process for the pressure impregnation of wood in which the liquid-borne active materials are deposited on the wood as by precipitation or chemical affixation before permitting kickback.

Another object of this invention is to provide improved methods and means for the pressure impregnation of wood with water-borne salt preservatives in which the retention of the salts within the wood is maximized.

Another object of this invention is to provide improved methods and means for the pressure impregnation of wood with water-borne salt preservatives in which the liquid retained within the wood is minimized.

Another object of this invention is to provide a process for the pressure impregnation of wood with water-borne preservatives which makes possible, during the treatment process, the treatment of the wood with other wood treatment materials.

Briefly, these and other objects of this invention are achieved by pressure impregnating wood with a water-borne treatment material, detaining the impregnated wood under pressure for a sufficient time for the water-borne treatment materials to react with or otherwise become fixed to the wood, and finally, after the treatment materials have completed at least their initial reaction with the wood, relieving the pressure and permitting kickback to occur. By these means, the amount of water-borne treatment materials in the kickback is reduced to a minimum and the need to process the kickback for recycling or discharge is largely avoided.

In its simplest form, this invention normally occur over a number of weeks following treatment and exposure can be made to occur during the impregnation process, thus making it practical to use the basic empty-cell process since the kickback will be substantially free of precipitating reaction products and high levels of unreacted treatment salts. In one embodiment of this invention, the treatment liquid, after impregnation, is drained from contact with the wood while maintaining sufficient pressure to prevent kickback. After the treatment liquid is removed from contact with the wood, the wood is heated as by steaming to increase the temperature of the wood and increase the rate and efficiency of the reactions. One reason that the treatment liquid may be drained from contact with the wood prior to the time the wood is heated is due to the belief, as is universally held by those skilled in the art, that CCA salts cannot be heated to above about 120° F. without causing precipitation of the CCA salts. This belief may have come about since, if CCA salts are heated prior to the time they are brought in contact with the wood, they readily precipitate within the wood at the start of the impregnation process, clog the outer cellular structure of the wood and thus make it difficult to impossible to obtain the desired degree and depth of impregnation into the wood.

It has now been discovered that CCA salts do not precipitate when heated if they are not in contact with wood at the time the heating takes place. Accordingly, in another embodiment of this invention the treatment solution may be used as the heat exchange medium (which is heated only after impregnation) for accelerating the chemical reactions within the wood. While some precipitation of the CCA salts may take place at the surface of the wood after impregnation and during subsequent heating, such precipitation is at worst nominal and it has proven possible to use the treatment liquid, after impregnation, as the heat exchange medium to achieve the desired chemical reactions in the wood before kickback.

In yet another embodiment of the instant invention, the treatment liquid may be drained away from contact with the wood while impregnating pressures are maintained to prevent kickback, and the wood is then heated to achieve the desired chemical reactions by introducing an aqueous heat exchange liquid into the treatment vessel which, if desired, may contain other wood treatment materials such as wood-softening agents, anti-checking agents, film-formers, coloring agents, dimensional stabilizers, flame-retardants, antistatic agents, and the like. By this means, a secondary treatment of at least the surface of the wood may be provided for during the same treatment procedure in which the wood is given a primary treatment.

EXAMPLE I

A charge of kiln-dry (15% moisture content) Southern pine tomato stakes and grape stakes consisting of thirty tomato stakes measuring 1"×1"×72"(1.25 cubic feet) and 15 grape stakes measuring 1 $\frac{5}{8}$"×1$\frac{5}{8}$"×72"(1.65 cubic feet) was given a modified empty-cell treatment with a 2.0% (oxide basis) solution of CCA as follows:

An initial pressure of 10 p.s.i. air was introduced into the treatment vessel and held for five minutes. The vessel was then filled with the CCA solution without relieving the initial pressure, and the pressure was increased to 100 p.s.i. in a forty-five minute period by increasing the pressure 10 p.s.i. at five minute intervals.

The excess preservative was removed while maintaining cylinder pressure at 100 p.s.i.

The gross absorption of the CCA solution during the pressurization period was 35.9 lbs/cu.ft.

The charge was steamed 1$\frac{1}{2}$ hours at 100 p.s.i. pressure with the maximum temperature of 240° F. being reached in one hour and then held at this temperature for a half hour.

A kick-back sample taken at the end of the steaming cycle had a pH of 3.1.

The charge was exposed to a 26" Hg. vacuum for one hour before being removed and weighed to determine net solution retention. The net solution retention obtained during treatment was 10.22 lbs/cu.ft.

Analysis of the original treating solution and kick-back resulting from the treatment of this charge gave the following results:

| Sample | pH | CuO | $CrO_3$ | $As_2O_5$ | % Reduction of: CuO | $CrO_3$ | $As_2O_5$ |
|---|---|---|---|---|---|---|---|
| Treatment solution | 1.5 | 0.345 | 0.958 | 0.718 | — | — | — |
| Kick-back | 3.1 | 0.021 | 0.016 | 0.019 | 93.9 | 98.3 | 97.4 |

EXAMPLE 2

Precipitation of Cu and Cr from acid copper chromate in kiln-dry (20% moisture content) Southern pine by steaming before permitting the kick-back to occur.

A piece of kiln-dry Southern pine 6½" in diameter and 18" long was impregnated as follows:

A. Preservative Solution:

A 2.38% solution (oxide basis) of acid copper chromate was prepared from a commercial (Celcure) concentrate of this preservative containing 3.84% copper sulfate (anhydrous), 5.01% sodium dichromate (anhydrous), and 0.20% chromic acid (anhydrous) by dilution with water. The pH of this fresh solution was 3.4.

B. Impregnation Cycle:

40 p.s.i. initial air was held five minutes, the treatment vessel was filled with the preservative solution at this pressure, and the pressure was then increased to 140 p.s.i. and held for two hours.

Excess preservative solution was drained from the vessel while maintaining the cylinder pressure at 140 p.s.i.

A kick-back sample was taken at the end of the pressure period but before starting the steaming by momentarily reducing the pressure slightly. The pH of this kick-back sample was 3.85.

The gross absorption of preservative during the pressure period was 29.29 lbs/cu.ft.

The sample was steamed at 212° F. for three hours while maintaining 140 p.s.i. pressure on the cylinder.

A kick-back sample taken at the end of the steaming cycle had a pH of 5.45.

The sample was exposed to a 26" Hg. vacuum for one hour before being removed and weighed to determine net solution retention.

A sample of the drip obtained during the final vacuum had a pH of 5.50.

The net solution retention obtained during treatment was 9.09 lbs/cu.ft. so that the gross absorption was reduced by over 20 lbs/cu.ft.

A disc obtained from the middle of this sample after treatment was dried in an oven to determine its average moisture content. Its moisture content expressed as a percent of oven-dry weight was 40.3%.

Analysis of the samples obtained during the treatment of this sample for Cu and Cr gave the results indicated in the table below. In this table, Sample 1 was the original treatment solution; Sample 2 was the kick-back after impregnation but before steaming; Sample 3 was the kick-back after impregnation and steaming; and Sample 4 was the drip from the wood during final vacuum.

| Sample | pH | % CuO | % Reduction of CuO | % $CrO_3$ | % Reduction of $CrO_3$ |
|---|---|---|---|---|---|
| 1 | 3.40 | 0.717 | — | 1.661 | — |
| 2 | 3.85 | 0.628 | 12.41 | 1.527 | 8.07 |
| 3 | 5.45 | 0.014 | 98.06 | 0.027 | 98.37 |
| 4 | 5.50 | 0.025 | 96.58 | 0.009 | 99.46 |

The disc obtained from this sample after treatment and steaming indicated complete penetration by the preservative.

EXAMPLE 3

In this example, the wood was given a pretreatment with $Ba(OH)_2$ prior to treatment with CCA to determine if the sugars could be precipitated in the wood so that they would not contaminate the kick-back.

A piece of kiln-dry Southern pine (20% mositure content) 5½" in diameter and 18" long was impregnated as follows:

A. $Ba(OH)_2$ Solution:

A 0.50% of $Ba(OH)_2$ (anhydrous) solution was prepared from a 1.00% solution by dilution with water.

B. $Ba(OH)_2$ Impregnation Cycle:

20 p.s.i. initial air pressure was established and held for five minutes. The treatment vessel was charged with the $Ba(OH)_2$ solution and a pressure of 120 p.s.i. was established and held for two hours.

Excess $Ba(OH)_2$ solution was drained from the vessel while maintaining cylinder pressure at 120 p.s.i.

A kick-back sample was taken by momentarily reducing the pressure slightly at the end of the pressure period but before starting the steaming cycle. The pH of this kick-back sample was 12.4.

The gross absorption of the $Ba(OH)_2$ solution during the pressure period was 31.24 lbs/cu.ft.

The sample was steamed at 212° F. for three hours while maintaining 120 psi pressure on the cylinder.

A kick-back sample was taken at the end of the steaming cycle. The pH of this sample was 6.1.

The sample was exposed to a 26" Hg. vacuum for one hour before being removed and weighed to determine net solution retention.

The net solution retention obtained during treatment was 2.50 lbs/cu.ft.

The sample was replaced in the cylinder immediately following the above weighing and given an empty-cell treatment in accordance with this invention with a 2% (oxide basis) solution of CCA as follows:

C. CCA Impregnation Cycle:

20 p.s.i. initial air pressure was established and held for five minutes. The treatment vessel was charged with the CCA solution and a pressure of 120 p.s.i. was established and held for two hours.

Excess CCA solution drained from the vessel while maintaining cylinder pressure at 120 p.s.i.

A kick-back sample was taken at the end of the pressure period but before starting the steaming cycle by momentarily reducing the pressure slightly. The pH of this kick-back sample was 2.3.

The gross absorption of the CCA solution during the pressure period was 26.48 lbs/cu.ft.

The sample was steamed at 212° F. for three hours while maintaining 120 p.s.i. pressure on the cylinder.

A kick-back sample was taken at the end of the steaming cycle. The pH of this sample was 4.0.

The sample was exposed to a 26" Hg. vacuum for one hour before being removed and weighed to determine net retention of CCA solution.

The net CCA solution retention was 3.24 lbs/cu.ft., with the total gain in weight during both impregnation cycles being 9.45 lbs/cu.ft.

The sample was sawed at midlength to determine the depth of penetration of the CCA solution. The entire cross section was penetrated.

Analysis of the kick-back samples obtained during the CCA impregnation cycle gave the following results. In the table, Sample 1 was the original treatment solution; Sample 2 was the kick-back after impregnation; and Sample 3 was the kick-back after steaming.

| | | | | | % Reduction of: | | |
|---|---|---|---|---|---|---|---|
| Sample | pH | CuO | $CrO_3$ | $As_2O_5$ | CuO | $CrO_3$ | $As_2O_5$ |
| 1 | 1.6 | 0.329 | 0.916 | 0.689 | — | — | — |
| 2 | 2.3 | 0.163 | 0.604 | 0.428 | 50.46 | 34.06 | 37.88 |
| 3 | 4.0 | 0.000 | 0.002 | 0.003 | 100.00 | 99.56 | 99.56 |

Enough CCA concentrate was added to a portion of Sample 3 to bring its concentration up to 2.0% (oxide basis) to determine if the Cu, Cr and As would remain in solution. No precipitate occurred in this sample after two weeks' storage in the laboratory, indicating that the wood sugars were precipitated in the wood and did not, to any observable extent, contaminate the kick-back.

EXAMPLES 4–6

In Examples 4 through 6, samples of Southern pine wood were treated with CCA salts under varying process conditions, as shown in the following table. In this table, the column headed "Initial p.s.i." indicates the pressure to which the wood was exposed prior to impregnation. The column headed "Impregnation p.s.i." indicates the pressure that was established within the treatment vessel after the vessel had been filled with the treatment liquid. The "Steaming Temperature" was the ultimate temperature reached, over a period of about an hour, after the impregnation pressure was imposed. The "Holding Time" is the period of time that the vessel was maintained at the impregnation pressure and the steaming temperature.

The other columns indicate the percentage of the active ingredients in the initial treatment solution, the kick-back, and the percentage of the active ingredients that were retained within the wood. Note that in Examples 4 and 5 where the temperature of the treatment vessel was not increased above ambient, the deposition of the CCA salts did not begin to approach completion even after a holding time of as long as six hours. In contrast to this, Example 6 shows that at a steaming temperature of 210° F., well over 95% of the CCA salts were deposited in the wood after a holding time of only two hours.

EXAMPLE 7

A charge of air-dried (25% moisture) pine fence posts about 4"×8'6" in size were placed in a pressure vessel and an initial air pressure of 20 psi was introduced into the treatment vessel and held for about five minutes. The vessel was then filled with a CCA solution (see Table 1) without relieving the initial pressure, and the pressure was increased to 140 psi over a period of about 55 minutes. The temperature of the CCA impregnating solution was about 90° F. and the gross absorption achieved was 31.4 lb/cu.ft.

When the required gross absorption had been obtained steam was admitted to the coils in the cylinder and the CCA solution in the cylinder was heated to 200° F. within 30 minutes and this temperature was maintained for 60 minutes. No precipitation of CCA salts from the treatment solution was noted during this heating cycle.

At the end of the heating period, the CCA solution was removed from the cylinder without permitting the pressure on the system to change, following which the pressure on the system was released to collect the kick-back separate from the CCA solution. The temperature of the kickback solution was 180° F. A final vacuum of 60 minutes at 25 in. Hg. followed after releasing the pressure on the system.

The wood was removed from the cylinder and weighed. It was determined that the net preservative solution retention was 7 lb/cu.ft.

Results of anaylses performed on the CCA before treatment, after treatment and heating and on a sample of the kickback after heating are contained in Table 1:

TABLE 1

| | | Metal Content (% oxide basis) | | | |
|---|---|---|---|---|---|
| Solution | pH | CuO | $CrO_3$ | $As_2O_5$ | Total Salt |
| CCA before treatment | 1.92 | 0.304 | 0.870 | 0.643 | 1.817 |
| CCA after treatment and heating | 2.03 | substantially the same as above | | | |
| Kickback | 4.18 | 0.008 | 0.017 | 0.022 | 0.047 |

An increment core was taken from midlength of each post for analysis for Cu, Cr and As retention after treatment. The cores were cut into ½" segments and similar segments were combined for analysis. Results for these analyses are contained in Table 2:

TABLE 2

| Depth from | Retention of Metals - lb/cu.ft. (Oxide Basis) | | | |
|---|---|---|---|---|
| Surface (inches) | CuO | $CrO_3$ | $As_2O_5$ | Total Salt |
| 0.0 to 0.5 | 0.161 | 0.352 | 0.251 | 0.765 |
| 0.5 to 1.0 | 0.123 | 0.244 | 0.019 | 0.385 |
| 1.0 to 1.5 | 0.074 | 0.177 | 0.014 | 0.265 |

The times, pressures and temperatures utilized in the above-described modified empty-cell process may vary substantially, depending upon the species of wood being treated and the nature of the treatment liquid. Also, the treatment times are temperature-dependent since the

| | | | | | TREATMENT SOLUTION | | | KICK-BACK | | | RETAINED SALTS | | |
|---|---|---|---|---|---|---|---|---|---|---|---|---|---|
| Example | Initial psi | Impregnation psi | Steaming Temp. | Holding Time | % CuO | % $CrO_3$ | $As_2O_5$ | % CuO | % $As_2O_5$ | % CuO | % $CrO_3$ | % $As_2O_5$ | % |
| 4 | 10 | 100 | None | 3 hrs. | 0.382 | 1.010 | 0.718 | 0.139 | 0.425 | 0.070 | 63.6 | 57.9 | 90.3 |
| 5 | 10 | 110 | None | 6 hrs. | 0.331 | 0.962 | 0.692 | 0.096 | 0.338 | 0.170 | 71.1 | 64.8 | 75.5 |
| 6 | 10 | 120 | 210° F. | 2 hrs. | 0.314 | 0.904 | 0.819 | 0.011 | 0.006 | 0.017 | 96.5 | 99.3 | 97.9 |

desired reactions generally take place faster at higher temperatures. By way of example, representative data has been obtained in treating Southern pine with CCA salts and it was found that temperatures ranging from about 150° F. to 250° F. are useful. At temperatures lower than these, the reaction rates are inconveniently slow, and at higher temperatures, damage may be done to the wood. A preferred temperature range for treating Southern pine with CCA salts is from about 180° F. to 240° F. and, more preferably still, from about 200° F. to 230° F.

Treatment times will vary considerably and, depending on the temperature used in the treatment cycle, satisfactory results have been obtained using treatment times of from about one to about seven hours. Longer times can, of course, be used, but in the interest of productivity of the process, no purpose is served in prolonging the treatment time after the desired reactions have neared or reached completion.

The modified empty-cell process of this invention has been described primarily with regard to the impregnation of wood with CCA salts, but it can readily be understood by those of ordinary skill in the wood treatment arts that the invention is of utility in treating wood with other wood preservatives such as, for example, pentachlorophenol. Further, the water-borne materials may include such things as wood-softening agents, antichecking agents, film-formers, coloring agents, flame retardants, antistatic agents, dimensional stabilizers, and other wood-treating agents. The process of this invention may also be used to leach materials, such as sugars, from wood, or, conversely, to precipitate sugars in the wood prior to a subsequent preservation step. The pH of the treatment liquid can be adjusted to maximize solubilization of the sugars and, if it is the object to fix the sugars in the wood, cations, such as barium or copper, may be included in the treatment liquid to form insoluble products with the sugars.

The modified empty-cell process of this invention makes it possible to conduct a plurality of sequential impregnations without the intervening drying or curing steps required in the full-cell process. For example, substantially immediately after wood is treated with CCA salts in accordance with this invention, it may be impregnated with oil-based preservatives. Another example would be to impregnate with preservative inorganic salts followed by a subsequent treatment with pentachlorophenol. This increases the degree of protection for the wood and is advantageous if aresenic salts must be excluded from the treatment liquid because of environmental hazards.

I claim:

1. A process for treating wood with water-borne materials, comprising;

placing the wood in a pressure vessel;

introducing the water-borne materials into the vessel and submerging the wood;

raising the pressure within the vessel and impregnating the wood with the water-borne materials until a desired gross absorption is achieved;

heating the interior of the vessel to a temperature of at least 150° F.;

maintaining the temperature and pressure after the gross absorption has been achieved for at least an hour and until a major portion of the water-borne materials become affixed to or precipitated on the wood; and relieving the pressure and collecting the kick-back.

2. A process according to claim 1 wherein at least 90% of the water-borne materials of the solution become fixed to or precipitated on the wood.

3. A process for treating wood in accordance with claim 1 wherein the water-borne materials are drained from external contact with the wood while maintaining a pressure within the vessel sufficient to prevent kick-back from occurring prior to the time the temperature and pressure are established to affix or precipitate the water-borne materials on the wood.

4. A process according to claim 1 in which the interior of the vessel is heated by heating the water-borne materials while they are in contact with the wood.

5. A process for treating wood in accordance with claim 4 wherein the water-borne materials are drained from the pressure vessel after the water-borne materials become affixed to or precipitated on the wood while a sufficient pressure is maintained to avoid kick-back and thereafter the pressure is relieved and the kick-back is separately collected.

6. A process according to claim 1 wherein the heating is from 180° F. to 240° F.

7. A process according to claim 1 wherein the heating is from 200° F. to 230° F.

8. A process according to claim 1 wherein the water-borne materials are CCA salts.

9. A process according to claim 1 wherein the water-borne materials pentachlorophenol or its salts.

10. A process according to claim 1 wherein the solution is drained from external contact with the wood while maintaining a sufficient pressure to prevent kick-back and the interior of the vessel is then heated by submerging the wood in a heated aqueous bath.

11. A process according to claim 9 wherein the aqueous bath includes water-borne treatment materials.

12. A process according to claim 10 wherein the water-borne wood treatment materials include wood softening agents, antichecking agents, film formers, coloring agents, dimensional stabilizers, flame retardants or antistatic agents.

* * * * *